US010890036B2

(12) United States Patent
Kosel et al.

(10) Patent No.: US 10,890,036 B2
(45) Date of Patent: Jan. 12, 2021

(54) DOWNHOLE TOOL AND METHOD OF ASSEMBLY

(71) Applicant: REPEAT PRECISION, LLC, Houston, TX (US)

(72) Inventors: Christopher J. Kosel, Houston, TX (US); Kenneth J. Kendrick, Chihuahua (MX); Andres E. Alvarado, Chihuahua (MX)

(73) Assignee: REPEAT PRECISION, LLC, Houston, TX (US)

( * ) Notice: Subject to any disclaimer, the term of this patent is extended or adjusted under 35 U.S.C. 154(b) by 0 days.

(21) Appl. No.: 16/283,047

(22) Filed: Feb. 22, 2019

(65) Prior Publication Data

US 2019/0264513 A1 Aug. 29, 2019

Related U.S. Application Data

(60) Provisional application No. 62/636,352, filed on Feb. 28, 2018.

(51) Int. Cl.

| | |
|---|---|
| ***E21B 19/07*** | (2006.01) |
| ***E21B 33/04*** | (2006.01) |
| ***E21B 19/10*** | (2006.01) |

(52) U.S. Cl.

CPC ..... *E21B 19/07* (2013.01); *E21B 19/10* (2013.01); *E21B 33/0422* (2013.01)

(58) Field of Classification Search

CPC ..... E21B 19/07; E21B 19/10; E21B 33/0422; E21B 33/1208; E21B 33/128; E21B 33/1292

See application file for complete search history.

(56) References Cited

U.S. PATENT DOCUMENTS

| | | | | |
|---|---|---|---|---|
| 8,915,305 | B2 | 12/2014 | Burgos | |
| 9,334,703 | B2 | 5/2016 | Vanlue | |
| 9,593,700 | B2 * | 3/2017 | Bynum | F16B 2/10 |
| 9,677,373 | B2 | 6/2017 | Harris | |
| 2005/0022885 | A1 * | 2/2005 | Marty | F16K 35/027 137/625.11 |
| 2014/0209294 | A1 * | 7/2014 | Sjostedt | E21B 33/134 166/135 |
| 2014/0261818 | A1 * | 9/2014 | Cruickshank | F16L 37/23 137/798 |
| 2016/0160929 | A1 * | 6/2016 | Janatka | F16D 1/0864 403/14 |
| 2018/0038191 | A1 * | 2/2018 | Davies | E21B 33/1293 |

FOREIGN PATENT DOCUMENTS

| | | | | |
|---|---|---|---|---|
| GB | 2513625 B | * | 2/2019 | |
| WO | WO-2017109506 A2 | * | 6/2017 | E21B 33/128 |
| WO | WO-2017116409 A1 | * | 7/2017 | A61K 9/0019 |

* cited by examiner

*Primary Examiner* — James G Sayre
(74) *Attorney, Agent, or Firm* — Blank Rome LLP

(57) ABSTRACT

A downhole tool for a wellbore and method of assembly. Components of the tool include a load member, one or slip members, one or more compression members, and a sealing element between the compression members mounted on a mandrel. The components are designed to prevent pre-set of the tool in the wellbore and facilitate removal of the tool from the wellbore.

26 Claims, 7 Drawing Sheets

DOWNHOLE TOOL AND METHOD OF ASSEMBLY

RELATED APPLICATION

This application claims priority to U.S. Provisional Application Ser. No. 62/636,352, filed Feb. 28, 2018 and entitled Downhole Tool and Method of Assembly.

FIELD OF THE INVENTION

The present invention relates to a downhole tool, such as those used in oil and gas wellbores.

BACKGROUND

Oil and gas wells typically use subterranean wellbores lined with a casing to add strength to the wellbore. Downhole tools, such as bridge plugs, frac plugs, or packers, are used in the casing to isolate sections of the wellbore. Downhole tools are usually constructed of durable metals, with a sealing element being formed of a compressible material that may also expand radially outward to engage the casing and seal off a section of the wellbore, thereby allowing an operator to control the passage or flow of fluids. Typical downhole tools are disclosed, for example, in U.S. Pat. Nos. 9,677,373, 9,334,703, and 8,915,305, the subject matter of each of which is herein incorporated by reference.

In fracing, for example, a downhole tool, such as a frac plug, is used in a wellbore below or beyond a respective target zone, followed by pumping or injecting high pressure frac fluid into the zone. The frac operation results in fractures or "cracks" in the formation that allow hydrocarbons to be more readily extracted and produced by an operator, and may be repeated as desired or necessary until all target zones are fractured.

Problems often occur when setting and removing the downhole tool from the wellbore. Therefore, a need exists for an improved downhole tool that avoids premature setting of the tool in the wellbore casing during run-in and facilitates removal of the tool from the wellbore.

SUMMARY

Accordingly, the present invention may provide a downhole tool for a wellbore that comprises a mandrel that has a stem portion and a hub portion at an end of the stem portion, a load member mounted on the stem portion of the mandrel, and at least one compression member mounted on the stem portion of the mandrel. The compression member has a body with a compression end configured to compress a sealing element. At least one slip member is mounted on the stem portion of the mandrel between one of the opposing ends of the load member and the body of the compression member. The slip member is configured for axial movement with respect to the mandrel. A bonding agent is disposed between an outer surface of the mandrel and an inner surface of the load member and disposed between an outer surface of the stem portion of the mandrel and an inner surface of the compression member. The bonding agent has a predetermined shear strength that fixes the load member and the compression member to the mandrel, thereby isolating and preventing axial movement of the at least one slip member with respect to the mandrel between the load member and the compression member.

In some embodiments, a second compression member is mounted on the stem portion of the mandrel that has a body with a compression end configured to compress the sealing element; the bonding agent is disposed between an outer surface of the stem portion of the mandrel and an inner surface of the second compression member, thereby fixing the second compression member to the mandrel; the sealing element is expandable and no bonding agent is disposed between the sealing element and the mandrel; and/or a second slip member is mounted on the stem portion of the mandrel between the body of the second compression member and an end cap installed on a distal end of the stem portion of the mandrel, the second slip member being configured for axial movement with respect to the mandrel, wherein the second compression member isolates and prevents axial movement with respect to the mandrel of the second slip member between the second compression member and the end cap.

In certain embodiments, the inner surface of the load member is tapered to correspond to a tapered shoulder of the outer surface of the mandrel with the bonding agent therebetween; the bonding agent is an adhesive or epoxy and the predetermined shear strength resists a shear force of greater than 1000 psi; the load member is a load ring, the compression member is a compression cone, and the slip member has one or more inserts configured to grab a casing of the wellbore; the opposing ends of the load member include a mounting end and an interface end, the interface end has a first anti-rotation feature; the slip member has an interface end that generally faces the interface end of the load member, the interface end of the slip member has a second anti-rotation feature configured to engage the first ant-rotation feature such that engagement of the first and second anti-rotation features prevents rotation of the load member and the slip member with respect to one another; and/or the body of the at least one compression member has at least one outer planar face that tapers inwardly from the compression end towards the mandrel for aligning with and engaging at least one corresponding inner planar surface of the slip member that tapers outwardly away from the mandrel to prevent rotation of the compression member and the slip member with respect to one another.

The present invention may also provide a downhole tool that comprises a mandrel that has a stem portion and a hub portion at an end of the stem portion; a load member mounted on the stem portion of the mandrel and that has opposing ends including a mounting end and an interface end with a first anti-rotation feature, and at least one slip member mounted on the stem portion of the mandrel, the slip member being configured for axial movement with respect to the mandrel, and the slip member has an interface end generally facing the interface end of the load member. The interface end of the slip member has a second anti-rotation feature configured to engage the first anti-rotation feature. Engagement of the first and second anti-rotation features prevents rotation of the load member and the slip member with respect to one another.

In one embodiment, the first anti-rotation feature is at least one protrusion and at least one detent sized to engage at least one corresponding detent and at least one corresponding protrusion, respectively, of the second anti-rotation feature. In other embodiments, a compression member is mounted on the stem portion of the mandrel such that the slip member is located between the load member and the compression member and the compression member has a body with a compression end for compressing a sealing element, the body has at least one outer planar face that tapers inwardly from the compression end towards the mandrel for aligning with and engaging at least one corresponding inner planar surface of a receiving end of the slip member that tapers outwardly away from the mandrel to prevent rotation of the compression member and the slip member with respect to one another; and/or a bonding agent is disposed between an outer surface of the mandrel and an inner surface of the load member and disposed between an outer surface of the stem portion of the mandrel and an inner surface of the compression member, wherein the bonding agent has a predetermined shear strength that fixes the load member and the compression member to the mandrel, thereby isolating and preventing axial movement of the at least one slip member with respect to the mandrel between the load member and the compression.

In an embodiment, the body of the compression member includes a plurality of outer planar surfaces that taper inwardly towards the mandrel, the plurality of outer planar surfaces define edge lines therebetween; and/or the receiving end of the slip member includes a plurality of inner planar surfaces that taper outwardly away from the mandrel configured to engage each of the plurality of outer planar surfaces, respectively, the plurality of inner planar surfaces define edge lines configured to align with the edge lines of the body of the compression member.

In another embodiment, a second slip member and a second compression member are mounted on the stem portion of the mandrel such that the slip member is located between the second compression member and an end cap installed on a distal end of the stem portion of the mandrel, the second slip member being configured for axial movement with respect to the mandrel, the second slip member has an interface end generally facing an interface end of the end cap, the interface end of the second slip member having a third anti-rotation feature configured to engage a fourth anti-rotation feature on the interface end of the end cap, thereby preventing rotation of the second slip member and the end cap with respect to one another. In yet another embodiment, the second compression member has a body with a compression end for compressing the sealing element, the body of the second compression member has at least one outer planar face that tapers inwardly from the compression end thereof towards the mandrel for aligning with and engaging at least one corresponding inner planar surface of a receiving end of the second slip member that tapers outwardly away from the mandrel to prevent rotation of the second compression member and the second slip member with respect to one another.

In a certain embodiment, the bonding agent is disposed between an outer surface of the stem portion of the mandrel and an inner surface of the second compression member to prevent movement of the second compression member with respect to the mandrel, thereby preventing axial movement of the second slip member with respect to the mandrel between the second compression member and the end cap. In one embodiment, the load member is a load ring and the slip member has one or more inserts configured to grip a casing of a wellbore.

The present invention may further provide a method of assembly of a downhole tool, comprising the steps of mounting a load member on a mandrel; applying a bonding agent between an inner surface of the load member and an outer surface of the mandrel; mounting a first slip member on the mandrel, the first slip member being configured for axial movement with respect to the mandrel; aligning an anti-rotation feature of the first slip member with an anti-rotation feature of the load member, thereby preventing rotation of the load member and the first slip member with respect to one another; mounting a first compression member on the mandrel; and applying the bonding agent between an inner surface of the compression member and an outer surface of the mandrel, wherein the bonding agent has a predetermined shear strength that fixes the load member and the first compression member to the mandrel, thereby isolating and preventing axial movement of the first slip member with respect to the mandrel between the load member and the first compression member.

In some embodiments, the method may further comprise the steps of installing an expandable sealing element on the mandrel adjacent a compression end of the first compression member without applying adhesive between the sealing member and the mandrel; mounting a second compression member on the mandrel and applying the bonding agent between an inner surface of the second compression member and an outer surface of the mandrel; mounting a second slip member on the mandrel, the second slip member being configured to move axially with respect to the mandrel; aligning an anti-rotation feature of the second slip member with an anti-rotation feature of an end cap installed on a distal end of the mandrel, thereby preventing rotation of the second slip member and the end cap with respect to one another; interlocking protrusions and detents of the anti-rotation features of the load member and the first slip member, respectively; and/or interlocking protrusion and detents of the anti-rotation features of the second slip member and the end cap.

In other embodiments, the second compression member used in the method prevents axial movement of the second slip member with respect to the mandrel between the second compression member and the end cap; and/or the step of preventing axial movement is done without using pins to mount the load member, the first compression member, or the second compression member to the mandrel.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE EXEMPLARY EMBODIMENTS

Figure 1:
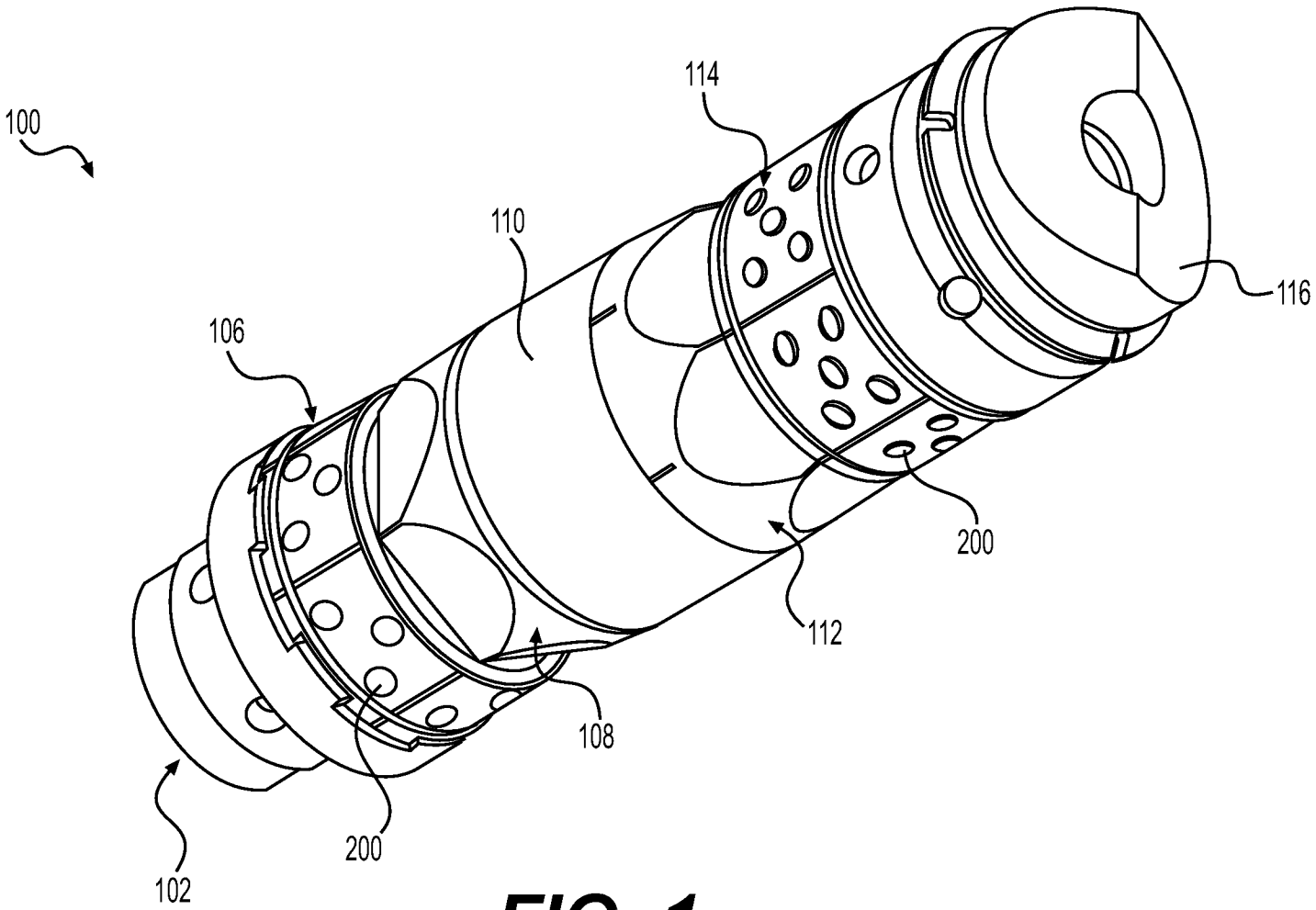
FIG. 1 is a perspective view of a downhole tool according to an exemplary embodiment of the present invention.
Figure 2:
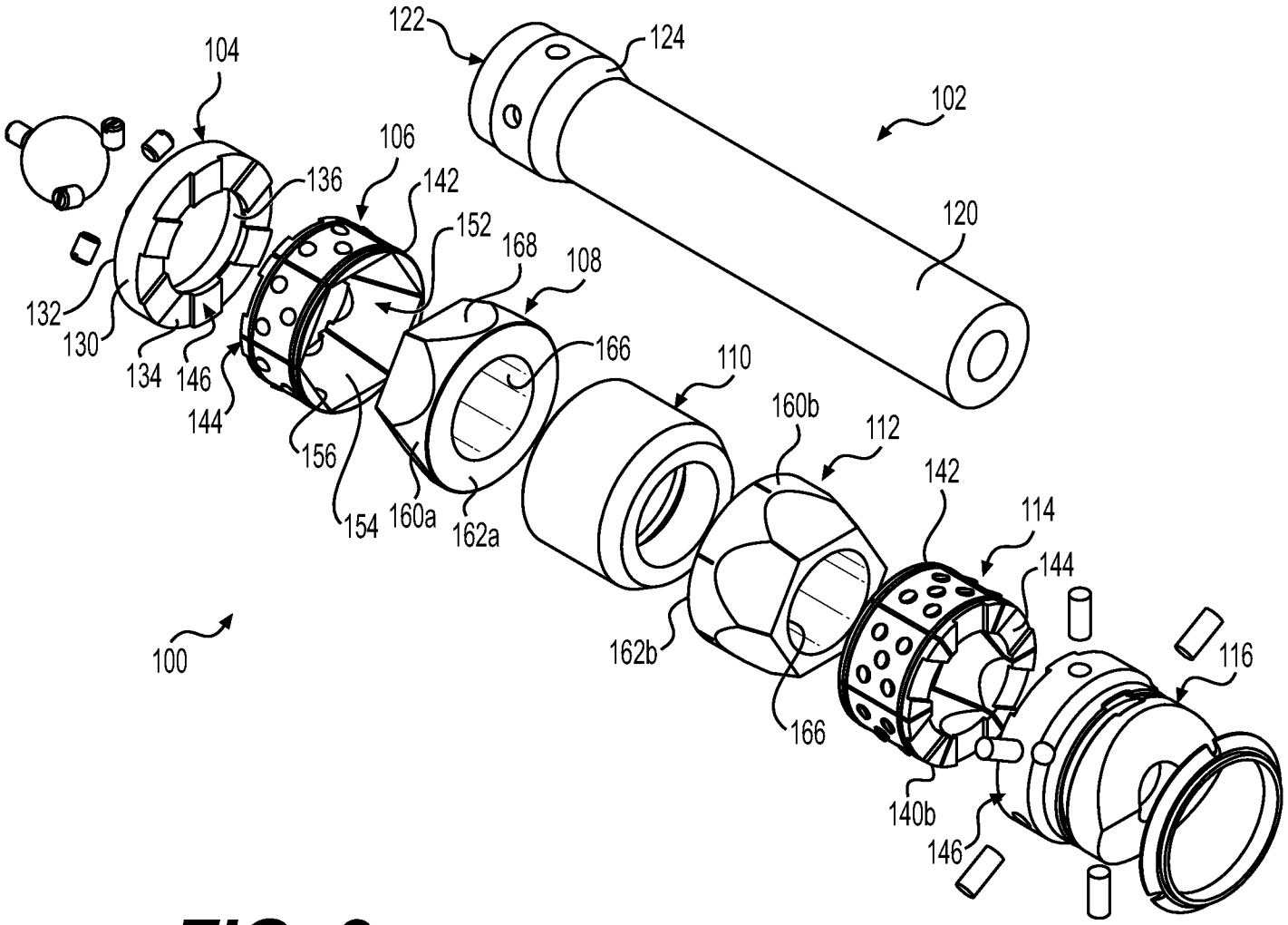
FIG. 2 is an exploded perspective view of the downhole tool illustrated in FIG. 1.

Referring to the figures, the present invention generally relates to a downhole tool 100, such as a bridge plug, a frac plug, a packer, a caged-ball frac plug, a drop-ball frac plug, or the like, used to isolate sections of a wellbore. As best seen in FIGS. 1 and 2, downhole tool 100 may have a number of assembled components, including a mandrel 102 that supports the components. The components may include a load member 104, a first slip member 106, a first compression member 108, a sealing element 110, a second compression member 112, a second slip member 114, and an end member 116. Sealing element 110 may be any expandable element known in the art to seal a section of a wellbore.

In accordance with exemplary embodiments of the present invention, a bonding agent may be applied between mandrel 102 and certain of the above components such that when tool 100 is assembled, those components are fixed to mandrel 102. This prevents premature setting or pre-set of tool 100 during run-in that often occurs due to impact with unforeseen obstructions in the wellbore. The bonding agent of the present invention is preferably an adhesive or epoxy with a predetermined shear strength high enough to resist an impact force from an obstruction if the tool were to impact an obstacle in the wellbore during run-in, such as debris, sand, or pieces of a plug previously used in the wellbore. The shear strength is determined by the maximum load force needed to break the bond created by the bonding agent. In one embodiment, the bonding agent is an adhesive or epoxy with a predetermined shear strength high enough to resist a shear force of 1000 psi or greater, preferably resists a shear force of between 1000 psi and 2000 psi, and more preferably resists a shear force of about 1250 psi.

Also in accordance with exemplary embodiments of the present invention, certain of the above components of tool 100 are designed with anti-rotation features to engage one another to prevent rotation therebetween when tool 100 is assembled. This maximizes efficiency of the tool when activated and facilitates removal of tool 100 during drill out from the wellbore by preventing the free spinning of the components.

Mandrel 102 generally includes a stem portion 120 and a hub portion 122 at one end of stem portion 120 where stem portion 120 has an outer diameter that is smaller than hub portion 122, thereby allowing mounting of the components of tool 100 thereon. Hub portion 122 may include a shoulder 124 that transitions to stem portion 120.

Figure 5B:
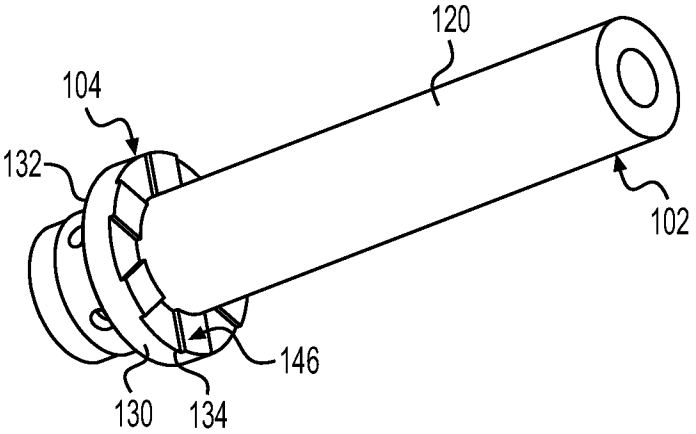
FIGS. 5*a*-5*f* are sequential perspective views of the downhole tool showing the steps of the assembly of the downhole tool according to an exemplary embodiment of the present invention.
Figure 5A:
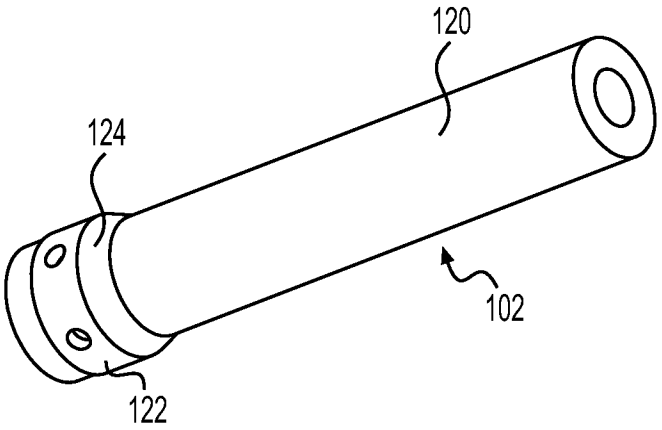

Load member 104 is configured to be mounted on mandrel 102, as seen in FIGS. 5*a* and 5*b*. Load member 104 may be a load ring that has a ring body 130 with opposing ends, including a mounting end 132 configured to abut hub portion 122 of mandrel 102 and an interface end 134 configured to engage first slip member 106, and an opening extending therebetween that is sized to receive stem portion 120. An inner surface 136 of ring body 130 may be tapered to correspond to and engage the taper of shoulder 124 of the mandrel's hub portion 122 when load member 104 is mounted on mandrel 102.

Figure 4:
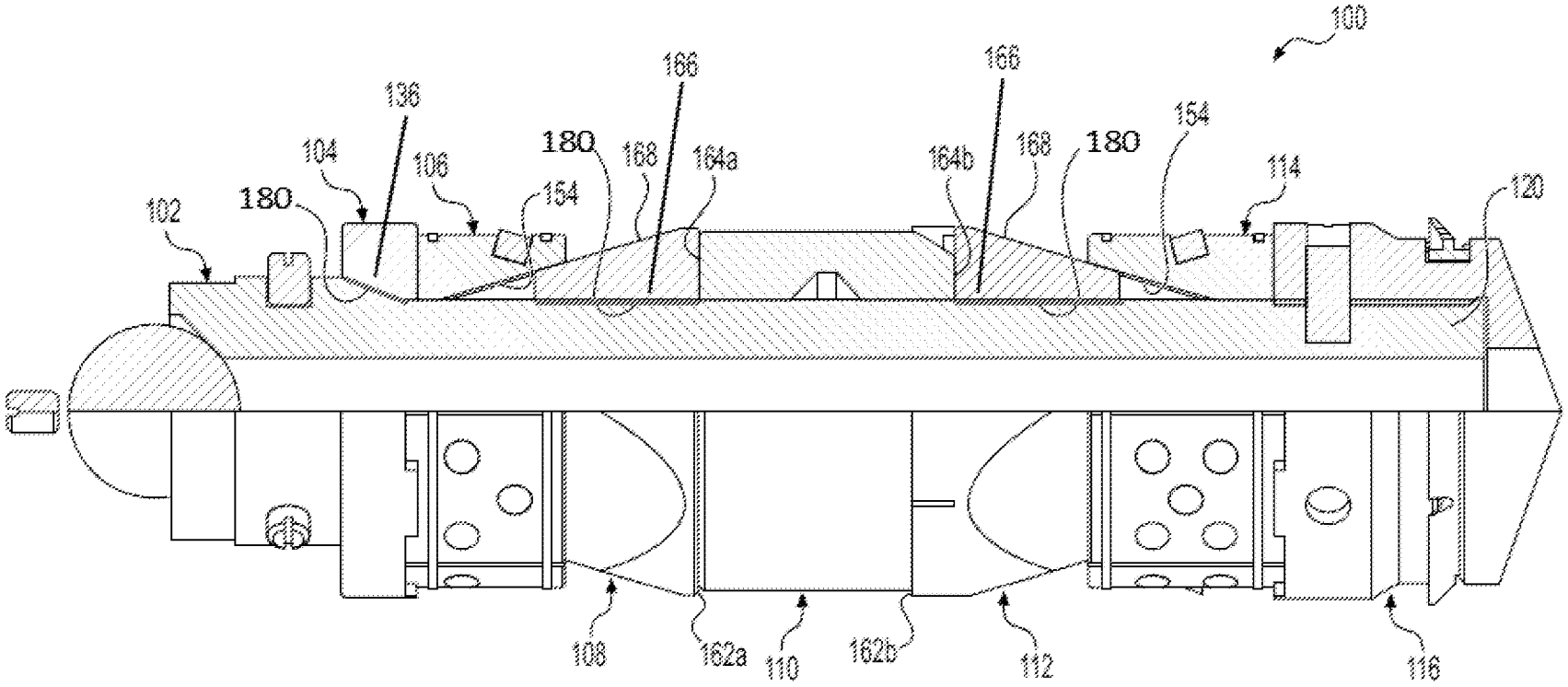
FIG. 4 is a partial cross-sectional side view of the downhole illustrated in FIG. 1.

In a preferred embodiment, as illustrated in FIG. 4, the bonding agent 180 of the present invention is applied between mandrel 102 and load member 104, such as between the outer surface of shoulder 124 and the load member's inner surface 136, to prevent movement of load member 104 with respect to mandrel 102. The bonding agent 180 fixes load member 104 in place on mandrel 102 during run-in of tool 100 until tool 100 is activated and compressed (such as by using a setting tool) with enough force to overcome the shear strength of the bonding agent therebetween.

Figure 5D:
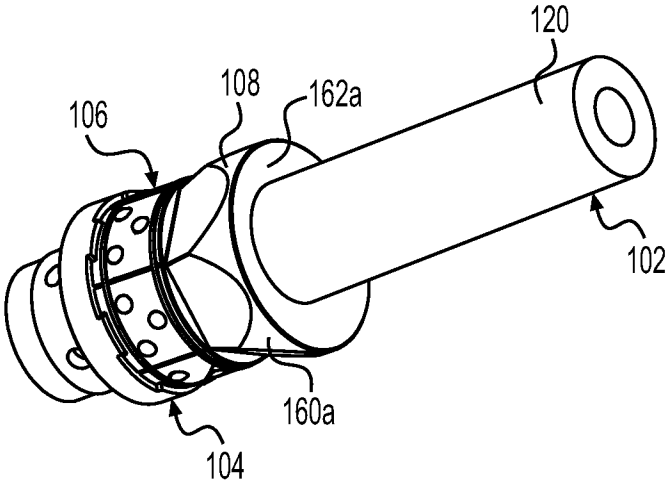
Figure 5C:
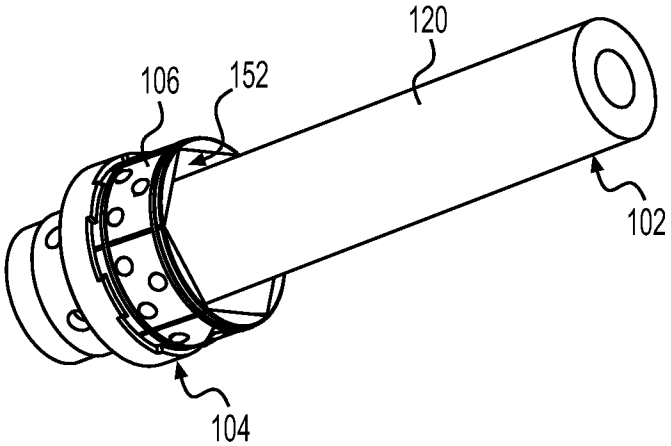
Figure 5F:
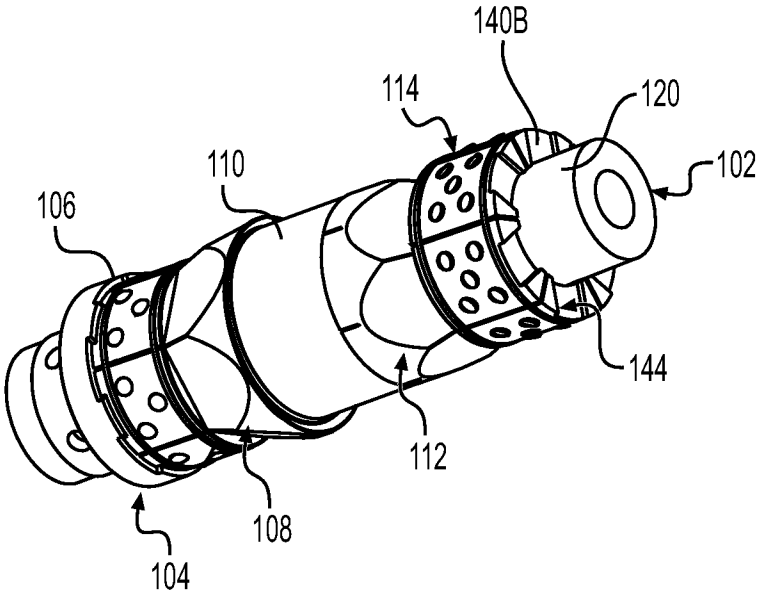

Slip members 106 and 114 are designed to grip the wellbore casing to hold downhole tool 100 in place in the wellbore and prevent it from moving once in the set position. Both first and second slip members 106 and 114 are configured to be mounted on the mandrel's stem portion 120, as seen in FIGS. 5*c* and 5*f*, respectively. Slip members 106 and 114 are mounted such that they are able to move axially with respect to mandrel 102 along the length of stem portion 120 when downhole tool 100 is compressed and moves from its set position to a compressed position to activate the tool where slip members 106 and 114 and sealing element 110 expand to seal or isolate a section of the wellbore. Each slip member 106 and 114 may include one or more outer inserts 200, such as pins, buttons, teeth or the like, for gripping the wellbore casing, as is well known in the art.

Figure 3:
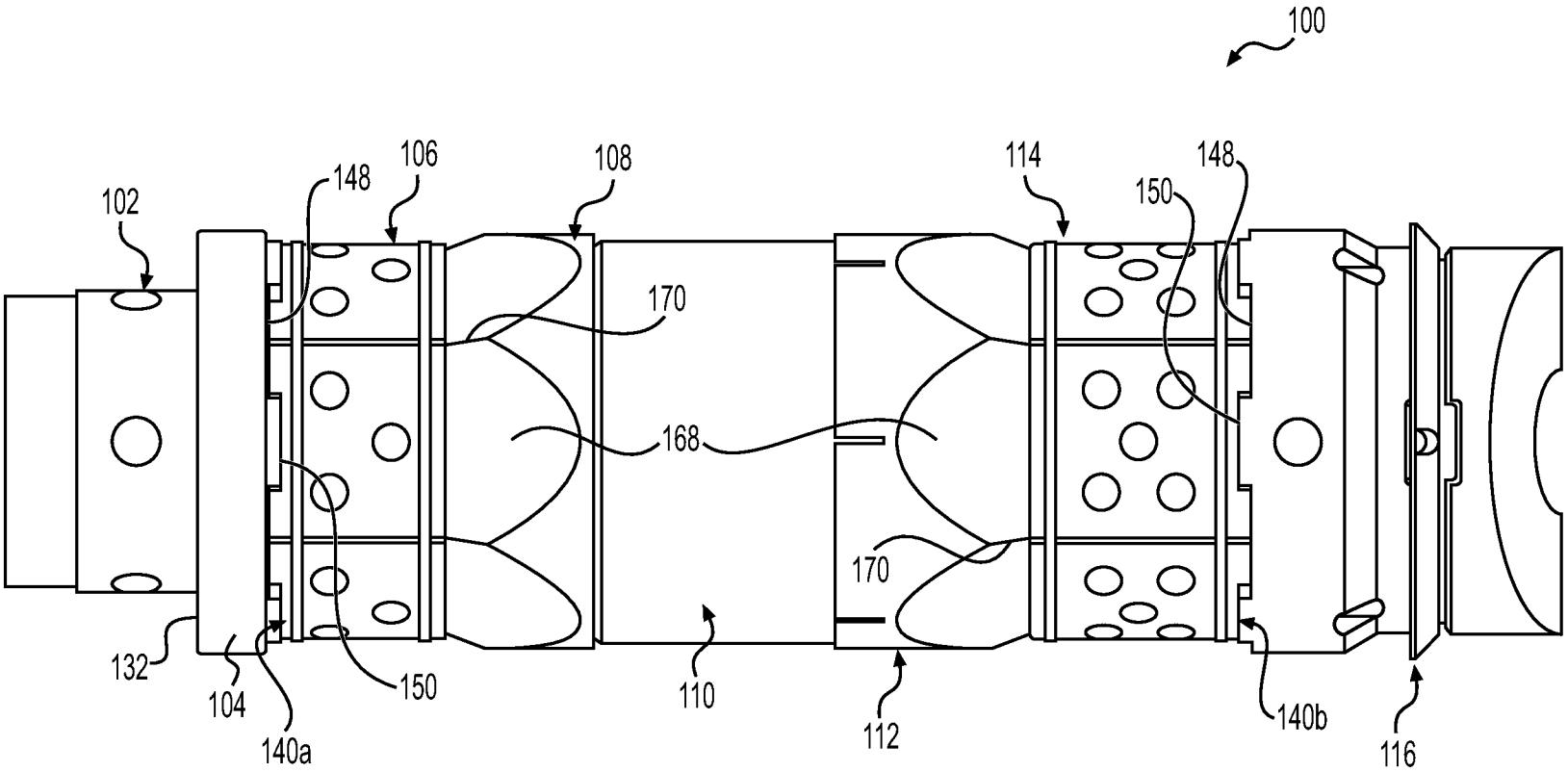
FIG. 3 is an elevational view of the downhole tool illustrated in FIG. 1.

First slip member 106 is mounted on the mandrel's stem portion 120 between load member 104 and first compression member 108 and second slip member 114 is mounted on the mandrel's stem portion 120 between second compression member 112 and end member 116 (such as an end cap). Each slip member 106 and 114 generally includes an interface end 140*a*, 140*b* (FIG. 3) and a receiving end 142 and an opening extending therebetween for receiving stem portion 120. Interface end 140*a* of first slip member 106 generally faces interface end 134 of load member 104 when first slip member 106 is mounted on mandrel 102 and interface end 140*b* of second slip member 114 generally faces end member 116 when mounted. Each of the slip members' interface ends 140*a*, 140*b* may include an anti-rotation feature 144 that engages a corresponding anti-rotation feature 146 of the load member's interface end 134 and of the end member 116, respectively, as seen in FIG. 2. Anti-rotation features 144 and 146 are configured to prevent rotation of load member 104 and first slip member 106 with respect to one another and rotation of second slip member 114 and end member 116. Anti-rotation features 144 and 146 may be, for example, one or more interlocking detents and protrusions 148 and 150, as best seen in FIG. 3. Any known type of interlocking may be used as the anti-rotation features 144 and 146, as long as load member 104 and slip member 106 cannot rotate with respect to one another and slip member 114 and end member 116 cannot rotate with respect to one another.

Receiving end 142 of each slip member 106 and 114 has an inner surface defining a receiving area 152 (FIG. 2) that is shaped and sized to receive an end of first and second compression members 108 and 112, respectively, when downhole tool 100 is moved to its compression position. One or more inner planar faces 154 may be provided in receiving area 152 on the inner surface for engaging compression member 108. Inner planar faces 154 preferably taper outwardly away from the mandrel's stem portion 120. Edge lines 156 are defined between adjacent individual planar faces 154, as best seen in FIG. 2.

Figure 5E:
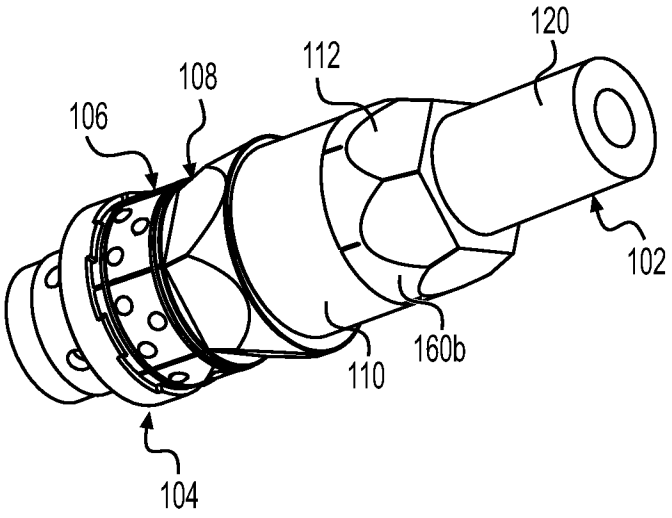

Compression members 108 and 112 are designed to compress sealing element 110 and also expand first and second slip members 106 and 114, respectively, when tool 100 is in the compressed position. First compression member 108 is mounted on the mandrel's stem portion 120 between first slip element 106 and sealing element 110 and second compression member 112 is mounted on stem portion 120 between sealing element 110 and second slip member 114, as seen in FIGS. 5*d*-5*f*. Each compression member 108 and 112 may be a cone with a body 160*a*, 160*b* having an opening that receives stem portion 120 and a compression end 162*a*, 162*b* that generally abuts sealing member 110. When tool 100 is activated, compression ends 162*a* and 162*b* engage and compress opposing ends 164*a* and 164*b* of sealing element 110 to force element 110 to expand. In a preferred embodiment, as illustrated in FIG. 4, the bonding agent 180 of the present invention is applied between mandrel 102 and each of the compression members 108 and 112, respectively, to prevent movement of compression members 108 and 112. For example, the bonding agent 180 may be applied between an inner surface 166 (FIG. 2 and FIG. 4) of each compression member 108 and 112 and a corresponding outer surface of the mandrel's stem portion 120. This fixes compression members 108 and 112 in place on mandrel 102 and isolates slip members 106 and 114 until tool 100 is activated in which the compression force of the setting tool overcomes the shear strength of the bonding agent 180. The bonding agent 180 does not need to be applied between sealing element 110 and mandrel 102.

One or more outer planar faces 168 may be provided on the body 160*a*, 160*b* of each compression member 108 and 112 that correspond to inner planar faces 154 of first and second slip members 106 and 114, respectively. Edge lines 170 (FIG. 2) are defined between adjacent individual planar faces 168 that can align with edge lines 156 of slip members 106 and 114, respectively, when tool 100 is activated. This assists with alignment between the respective slip members 106 and 114 and the compression members 108 and 112 when tool 100 is compressed upon activation. When compression body 160*a*, 160*b* of compression members 108 and 112 are received in the receiving areas 156 of slip members 106 and 114, respectively, inner and outer planar faces 154 and 168 engage one another, such as in a friction fit. This engagement of planar surfaces 154 and 168 also assists with preventing rotation of the components with respect to one another.

FIGS. 5*a*-5*f* illustrate the steps of assembly of downhole tool 100. To assemble downhole tool 100, load member 104 is first mounted on mandrel 102, as seen in FIG. 5*b*, such that its inner surface 136 engages shoulder 124 of hub portion 122. The bonding agent of the present invention is preferably applied between inner surface 136 and shoulder 124 to fix load member 104 to mandrel 102. Next, first slip member 106 is mounted on mandrel 102 next to load member 104, as seen in FIG. 5*c*. Anti-rotation features 144 and 146 of load member 104 and slip member 106 are aligned and engaged, thereby preventing rotation of load member 104 and first slip member 106 with respect to one another. First compression member 108 is then mounted on mandrel 102 adjacent first slip member 106, as seen in FIG. 5*d*. The bonding agent of the present invention is preferably also applied between the inner surface 166 of first compression member 108 and a corresponding outer surface of stem portion 102 to fix first compression member 108 on mandrel 102. This isolates slip member 106 between load member 104 and compression member 108 to prevent premature movement and expansion of slip member 106.

The expandable sealing element 110 and second compression member 112 may then be installed on mandrel 102 such that sealing element 110 is disposed between first and second compression members 108 and 112, as seen in FIG. 5*e*. The bonding agent of the present invention is preferably again applied between the inner surface 166 of second compression member 112 and a corresponding outer surface of stem portion 120 to fix second compression member 112 on mandrel 102. No bonding agent is applied between sealing element 110 and mandrel 102. Second slip member 114 may then be mounted on mandrel 102 adjacent second compression member 112, as seen in FIG. 5*f*. Finally, end member 116 is mounted on the end of stem portion 120 adjacent to and aligned with second slip member 114, as seen in FIG. 1. This isolates slip member 114 between second compression member 112 and end member 116 to prevent premature movement and activation of slip member 114. Anti-rotation features 144 and 146 of slip member 114 and end member 116 are aligned and engaged, thereby preventing rotation of slip member 114 and end member 116 with respect to one another.

In operation, the downhole tool 100 is run into the wellbore casing and lowered to a set position. The use and application of the bonding agent with the predetermined shear strength of the present invention, which fixes load member 104, first compression member 108, and second compression member 112 on mandrel 102, prevents premature setting or pre-set of tool 100 during run-in of tool 100 because the slip members 106 and 114 are not able to activate or expand even if the tool 100 impacts an unforeseen obstruction in the wellbore. That is, fixed load member 104 and fixed first compression member 108 isolate and prevent axial movement or expansion of first slip member 106 positioned therebetween. Likewise, fixed second compression member 116 isolates and prevents axial movement or expansion of second slip member 114 between it and end member 116 (which may be secured to the end of mandrel 102 in any known manner). The bonding agent of the present invention also provides this protection against pre-set without the need for pins to assemble and mount the components of tool 100 to mandrel 102. This is beneficial because use of the bonding agent instead of pins is cost efficient and the strength of the composite material of the components is maintained. That is because the need to drill holes in the components of tool 100 (to accept the pins), which reduces the strength of the composite material of the components, is avoided.

Once the tool is in the proper set position, tool 100 is ready for activation. When activated, the shear strength of the bonding agent is overcome by application of a compression force by the setting tool to release the bond between load member 104, compression members 108 and 112, and mandrel 102. This allows the tool to be compressed so that slip members 106 and 114 and sealing element 110 expand outwardly to respectively clamp the tool to the casing of the wellbore. Once operations are complete, tool 100 is removed from the wellbore, typically by drilling or machine milling the tool. Interlocking of anti-rotation features 144 and 146 of the present invention, which prevent rotation between load member 104 and first slip member 106 and prevent rotation between second slip member 114 and end member 116, assists with drilling out of tool 100 to maximize removal efficiency of tool 100. That is, as the drill bit is rotating and drilling into tool 100, the anti-rotating features 144 and 146 keep the components engaged with one another with respect to the wellbore casing, thereby preventing free spinning of the components or one component from spinning within another component, as tool 100 is being drilled out.

While particular embodiments have been chosen to illustrate the invention, it will be understood by those skilled in the art that various changes and modifications can be made therein without departing from the scope of the invention as defined in the appended claims.

What is claimed is:

1. A downhole tool for a wellbore, comprising:

a mandrel having a stem portion and a hub portion at an end of the stem portion;

a load member mounted on the stem portion of the mandrel, the load member having opposing ends;

at least one compression member mounted on the stem portion of the mandrel, the compression member having a body with a compression end configured to compress a sealing element;

at least one slip member mounted on the stem portion of the mandrel between one of the opposing ends of the load member and the body of the compression member, the slip member being configured for axial movement with respect to the mandrel; and a bonding agent disposed between an outer surface of the mandrel and an inner surface of the load member and disposed between an outer surface of the stem portion of the mandrel and an inner surface of the compression member, wherein the bonding agent has a predetermined shear strength that fixes the load member and the compression member to the mandrel, thereby isolating and preventing axial movement of the at least one slip member with respect to the mandrel between the load member and the compression member.

2. The downhole tool of claim 1, further comprising a second compression member mounted on the stem portion of the mandrel, the second compression member having a body with a compression end configured to compress the sealing element; and the bonding agent is disposed between an outer surface of the stem portion of the mandrel and an inner surface of the second compression member, thereby fixing the second compression member to the mandrel.

3. The downhole tool of claim 2, wherein the sealing element is expandable and no bonding agent is disposed between the sealing element and the mandrel.

4. The downhole tool of claim 2, further comprising a second slip member mounted on the stem portion of the mandrel between the body of the second compression member and an end cap installed on a distal end of the stem portion of the mandrel, the second slip member being configured for axial movement with respect to the mandrel, wherein the second compression member isolates and prevents axial movement with respect to the mandrel of the second slip member between the second compression member and the end cap.

5. The downhole tool of claim 1, wherein the inner surface of the load member is tapered to correspond to a tapered shoulder of the outer surface of the mandrel with the bonding agent therebetween.

6. The downhole tool of claim 1, wherein the bonding agent is an adhesive or epoxy and the predetermined shear strength thereof resists a shear force between 1000 psi and 2000 psi.

7. The downhole tool of claim 1, wherein the load member is a load ring, the compression member is a compression cone, and the slip member has one or more inserts configured to grab a casing of the wellbore.

8. The downhole tool of claim 1, wherein the opposing ends of the load member include a mounting end and an interface end, the interface end has a first anti-rotation feature; and the slip member has an interface end that generally faces the interface end of the load member, the interface end of the slip member has a second anti-rotation feature configured to engage the first ant-rotation feature such that engagement of the first and second anti-rotation features prevents rotation of the load member and the slip member with respect to one another.

9. The downhole tool of claim 8, wherein the body of the at least one compression member has at least one outer planar face that tapers inwardly from the compression end towards the mandrel for aligning with and engaging at least one corresponding inner planar surface of the slip member that tapers outwardly away from the mandrel to prevent rotation of the compression member and the slip member with respect to one another.

10. The downhole tool of claim 1, wherein the bonding agent is not disposed between the sealing element and the mandrel.

11. A downhole tool, comprising:

a mandrel having a stem portion and a hub portion at an end of the stem portion;

a load member mounted on the stem portion of the mandrel, the load member having opposing ends including a mounting end and an interface end, the interface end having a first anti-rotation feature;

at least one slip member mounted on the stem portion of the mandrel, the slip member being configured for axial movement with respect to the mandrel, the slip member having an interface end generally facing the interface end of the load member, the interface end of the slip member having a second anti-rotation feature configured to engage the first anti-rotation feature;

a compression member mounted on the stem portion of the mandrel such that the at least one slip member is located between the load member and the compression member; and a bonding agent disposed between an outer surface of the mandrel and an inner surface of the load member and between an outer surface of the stem portion of the mandrel and an inner surface of the compression member, wherein engagement of the first and second anti-rotation features prevents rotation of the load member and the slip member with respect to one another.

12. The downhole tool of claim 11, wherein the first anti-rotation feature is at least one protrusion and at least one detent sized to engage at least one corresponding detent and at least one corresponding protrusion, respectively, of the second anti-rotation feature.

13. The downhole tool of claim 11, wherein the compression member has a body with a compression end for compressing a sealing element, the body has at least one outer planar face that tapers inwardly from the compression end towards the mandrel for aligning with and engaging at least one corresponding inner planar surface of a receiving end of the slip member that tapers outwardly away from the mandrel to prevent rotation of the compression member and the slip member with respect to one another.

14. The downhole tool of claim 11, wherein the bonding agent is an adhesive or epoxy with a predetermined shear strength that fixes the load member and the compression member to the mandrel, thereby isolating and preventing axial movement of the at least one slip member with respect to the mandrel between the load member and the compression.

15. The downhole tool of claim 11, wherein the body of the compression member includes a plurality of outer planar surfaces that taper inwardly towards the mandrel, the plurality of outer planar surfaces define edge lines therebetween; and the receiving end of the slip member includes a plurality of inner planar surfaces that taper outwardly away from the mandrel configured to engage each of the plurality of outer planar surfaces, respectively, the plurality of inner planar surfaces define edge lines configured to align with the edge lines of the body of the compression member.

16. The downhole tool of claim 11, further comprising a second slip member and a second compression member mounted on the stem portion of the mandrel such that the slip member is located between the second compression member and an end cap installed on a distal end of the stem portion of the mandrel, the second slip member being configured for axial movement with respect to the mandrel, the second slip member has an interface end generally facing an interface end of the end cap, the interface end of the second slip member having a third anti-rotation feature configured to engage a fourth anti-rotation feature on the interface end of the end cap, thereby preventing rotation of the second slip member and the end cap with respect to one another.

17. The downhole tool of claim 16, wherein the second compression member has a body with a compression end for compressing the sealing element, the body of the second compression member has at least one outer planar face that tapers inwardly from the compression end thereof towards the mandrel for aligning with and engaging at least one corresponding inner planar surface of a receiving end of the second slip member that tapers outwardly away from the mandrel to prevent rotation of the second compression member and the second slip member with respect to one another.

18. The downhole tool of claim 16, wherein the bonding agent disposed between an outer surface of the stem portion of the mandrel and an inner surface of the second compression member to prevent movement of the second compression member with respect to the mandrel, thereby preventing axial movement of the second slip member with respect to the mandrel between the second compression member and the end cap.

19. The downhole tool of claim 11, wherein the load member is a load ring and the slip member has one or more inserts configured to grip a casing of a wellbore.

20. A method of assembly of a downhole tool, comprising the steps of mounting a load member on a mandrel;

applying a bonding agent between an inner surface of the load member and an outer surface of the mandrel;

mounting a first slip member on the mandrel, the first slip member being configured for axial movement with respect to the mandrel;

aligning an anti-rotation feature of the first slip member with an anti-rotation feature of the load member, thereby preventing rotation of the load member and the first slip member with respect to one another;

mounting a first compression member on the mandrel; and applying the bonding agent between an inner surface of the compression member and an outer surface of the mandrel, wherein the bonding agent is an adhesive or epoxy with a predetermined shear strength that fixes the load member and the first compression member to the mandrel, thereby isolating and preventing axial movement of the first slip member with respect to the mandrel between the load member and the first compression member.

21. The method of claim 20, further comprising the step of installing an expandable sealing element on the mandrel adjacent a compression end of the first compression member without applying adhesive between the sealing member and the mandrel.

22. The method of claim 21, further comprising the steps of mounting a second compression member on the mandrel and applying the bonding agent between an inner surface of the second compression member and an outer surface of the mandrel.

23. The method of claim 22, further comprising the steps of mounting a second slip member on the mandrel, the second slip member being configured to move axially with respect to the mandrel; and aligning an anti-rotation feature of the second slip member with an anti-rotation feature of an end cap installed on a distal end of the mandrel, thereby preventing rotation of the second slip member and the end cap with respect to one another.

24. The method of claim 23, wherein the second compression member prevents axial movement of the second slip member with respect to the mandrel between the second compression member and the end cap.

25. The method of claim 24, wherein the step of preventing axial movement is done without using pins to mount the load member, the first compression member, or the second compression member to the mandrel.

26. The method of claim 23, further comprising the step of interlocking protrusions and detents of the anti-rotation features of the load member and the first slip member, respectively; and interlocking protrusion and detents of the anti-rotation features of the second slip member and the end cap.

* * * * *